US012808297B2

(12) United States Patent
Al-Hamad et al.

(10) Patent No.: US 12,808,297 B2
(45) Date of Patent: Nov. 24, 2026

(54) QUALITY ASSESSMENT OF DOWNHOLE RESERVOIR FLUID SAMPLING BY PREDICTED INTERFACIAL TENSION

(71) Applicants: SCHLUMBERGER TECHNOLOGY CORPORATION, Sugar Land, TX (US); SAUDI ARABIAN OIL COMPANY, Dhahran (SA)

(72) Inventors: Mohammed Fadhel Al-Hamad, Dhahran (SA); Wael Abdallah, Sugar Land, TX (US); Tariq Ahmed Mattar, Hassi Messaoud (SA); Ramy Ahmed Mohamed, Al-Khobar (SA); Saleh Almair, Dhahran (SA); Shouxiang Ma, Dhahran (SA)

(73) Assignees: Schlumberger Technology Corporation, Sugar Land, TX (US); Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/105,798

(22) PCT Filed: Aug. 22, 2022

(86) PCT No.: PCT/US2022/041020

§ 371 (c)(1),
(2) Date: Feb. 22, 2025

(87) PCT Pub. No.: WO2024/043868

PCT Pub. Date: Feb. 29, 2024

(65) Prior Publication Data

US 2026/0071542 A1 Mar. 12, 2026

(51) Int. Cl.
*E21B 49/08* (2006.01)
*E21B 47/06* (2012.01)

(52) U.S. Cl.
CPC ..... *E21B 49/0875* (2020.05); *E21B 47/06* (2013.01); *E21B 49/088* (2013.01)

(58) Field of Classification Search
CPC .... E21B 49/08; E21B 49/0875; E21B 49/088; E21B 49/081; E21B 47/00
See application file for complete search history.

(56) References Cited

U.S. PATENT DOCUMENTS

2006/0250130 A1 11/2006 Akkurt et al.
2009/0150079 A1 6/2009 Hsu et al.
(Continued)

OTHER PUBLICATIONS

International Search Report and Written Opinion of International Patent Application No. PCT/US2022/041020 dated on May 22, 2023, 09 pages.

(Continued)

*Primary Examiner* — Zakiya W Bates
(74) *Attorney, Agent, or Firm* — Bridget M. Laffey

(57) ABSTRACT

Methods and systems are provided that configure a downhole tool disposed within a wellbore adjacent a reservoir to perform fluid sampling operations that draw live reservoir fluid from the reservoir into the downhole tool. The live reservoir fluid is at elevated pressure and temperature conditions of the reservoir. The live reservoir fluid is analyzed within the downhole tool to determine fluid properties of the live reservoir fluid. Interfacial tension of the live reservoir fluid can be determined or predicted from the fluid properties of the live reservoir fluid. The interfacial tension of the live reservoir fluid can be used to characterize and assess quality of the live reservoir fluid in substantially real-time. The characterization and assessment of the quality of the live reservoir fluid can be used to control the sampling operations or initiate downhole fluid analysis or sample collection for analysis of "clean" reservoir fluid of acceptable quality.

20 Claims, 9 Drawing Sheets

(56) References Cited

U.S. PATENT DOCUMENTS

| | | | | |
|---|---|---|---|---|
| 2013/0071934 | A1 | 3/2013 | Indo et al. | |
| 2018/0156939 | A1* | 6/2018 | Stukan | E21B 47/06 |
| 2020/0003053 | A1 | 1/2020 | Pelletier et al. | |
| 2020/0096429 | A1* | 3/2020 | Andersen | G01N 13/02 |
| 2022/0035971 | A1 | 2/2022 | Mahavadi et al. | |

OTHER PUBLICATIONS

Williams, J.M., "Fluid Sampling Under Adverse Conditions", Revue de l'Institut Français du Pétrole, 1998, pp. 355-365, 53(3), IFP Energies Nouvelles.

Zuo, J.Y. et al., "A Breakthrough in Accurate Downhole Fluid Sample Contamination Prediction in Real Time", Petrophysics, SPWLA-2015-v56n3a2, Jun. 2015, pp. 251-265, 56 (03), One Petro.

Bouton, J. et al., "Assessment of Sample Contamination by Downhole NMR Fluid Analysis", SPE Annual Technical Conference and Exhibition, SPE-71714-MS, 2001, 10 pages, One Petro, New Orleans, Louisiana, US.

* cited by examiner

Table 1 Sampled crude oil properties

| Oil | Pressure [psi] | Temperature [F] | API | Oil Density [g/cc] | Oil Viscosity [cP] |
|---|---|---|---|---|---|
| Crude 1 | 3329 | 229 | 25.7 | 0.831 | 3.03 |
| Crude 2 | 1962 | 183 | 29.9 | 0.821 | 2.74 |
| Crude 3 | 2329 | 131 | 54.6 | 0.759 | 0.74 |
| Crude 4 | 3897 | 201 | 44.5 | 0.618 | 0.23 |
| Crude 5 | 2800 | 157 | 35.4 | 0.779 | 1.40 |
| Crude 6 | 1718 | 144 | 41.9 | 0.768 | 1.03 |
| Crude 7 | 6500 | 221 | 41.7 | 0.757 | 0.66 |
| Crude 8 | 3284 | 187 | 33.1 | 0.820 | 2.74 |

Table 2. IFT sensitivity to oil viscosity change

| Oil | Pressure [psi] | Temperature [F] | API | Oil Density [g/cc] | Viscosity factor | Oil Viscosity [cP] | IFT calculated [mN/m] |
|---|---|---|---|---|---|---|---|
| Crude 2 | 1962 | 183 | 29.89 | 0.821 | 1 | 2.74 | 27.91 |
| | | | | | 2 | 5.47 | 38.15 |
| | | | | | 4 | 10.95 | 61.45 |
| | | | | | 5 | 13.69 | 74.27 |
| Crude 3 | 2329 | 131 | 54.64 | 0.759 | 1 | 0.74 | 27.52 |
| | | | | | 2 | 1.48 | 30.76 |
| | | | | | 4 | 2.96 | 37.71 |
| | | | | | 5 | 3.70 | 41.35 |

FIG. 6

Table 3. IFT sensitivity to oil density change

| Oil | Pressure [psi] | Temperature [F] | API | Density Factor | Oil Density [g/cc] | Oil Viscosity [cP] | IFT calculated [mN/m] |
|---|---|---|---|---|---|---|---|
| Crude 2 | 1962 | 183 | 29.89 | 0% | 0.821 | 2.74 | 27.91 |
| | | | | 3% | 0.846 | | 26.52 |
| | | | | 6% | 0.870 | | 25.12 |
| Crude 3 | 2329 | 131 | 54.64 | 0% | 0.759 | 0.74 | 27.52 |
| | | | | 3% | 0.782 | | 26.47 |
| | | | | 6% | 0.827 | | 24.33 |

FIG. 7

QUALITY ASSESSMENT OF DOWNHOLE RESERVOIR FLUID SAMPLING BY PREDICTED INTERFACIAL TENSION

FIELD

The present disclosure relates to methods and systems that sample and analyze reservoir fluids in a downhole environment.

BACKGROUND

Understanding reservoir fluid properties is essential throughout the life cycle of a reservoir, from discovery all the way to abandonment. Such properties can be obtained by conducting Pressure-Volume-Temperature (PVT) measurements on uncontaminated reservoir fluids sampled from the downhole reservoir/formation. These measured properties are key parameters to estimate hydrocarbon reserves and assess the best scenarios for its recovery and hence critical for reservoir management plans. The acquisition and analysis of representative reservoir fluid samples are also important in many aspects of reservoir engineering, reservoir production, and petroleum economics. Therefore, acquiring representative and reliable reservoir fluid samples is critical.

It is known that reservoir fluid sampling is an expensive operation, yet a relative high number (about 20%) of reservoir fluid samples sampled in situ contain a sufficiently high level (such as higher than 5%) of contamination (i.e., drilling fluid filtrates) that results in either the reservoir fluid samples being useless or the fluid properties measured from the reservoir fluid samples being not-representative of reservoir fluids in situ.

Reservoir fluid samples can be collected downhole via a wireline or logging-while-drilling (LWD) downhole tool typically referred to as formation tester tool. The formation tester tool is typically run in an open-hole to the required depth. The formation tester tool typically includes a number of modules that can be divided into four main categories: inlet or probe, flowline(s) and pump(s) and valve(s), fluid analyzers or sensors, and sample carriers. The inlet or probe of the formation tester tool is utilized to establish communication with the formation/reservoir. The size and specification of the inlet or probe of the formation tester tool can be configured according to the properties of the reservoir under investigation, including rock properties such as permeability, fluid properties such as viscosity, and wellbore conditions. After successfully establishing communication with the formation/reservoir, the pump(s) of the formation tester tool is (are) typically operated to initiate a cleanup (of drilling fluid filtrate contamination) process that draws reservoir fluids into the flowline(s). Because the well is drilled with drilling fluid, drilling fluid filtrates (which are commonly referred to as "drilling mud filtrates" or "mud filtrates") can invade the formation and contaminate the reservoir fluid drawn into the flowline(s) during the cleanup process. [M. Williams. Fluid Sampling under Adverse Conditions. Revue de l'Institut Français du Pétrole, EDP Sciences, 1998, 53 (3), pp. 355-365. ff10.2516/ogst:1998031ff. ffhal-02078992f1]. Therefore, in most cases, the initial fluids drawn into the flowline(s) includes drilling fluid filtrates and then gradually the percentage of "clean" reservoir fluid percentage increases until an acceptable level of contamination (such as less than 5%) is achieved and the cleanup process is completed. During the cleanup process, the fluid analyzers or sensors of the tool can be used to measure properties of the fluid drawn into the tool and such properties can be evaluated to estimate the level of contamination and determine when an acceptable level of contamination (such as less than 5%) has been achieved. After the cleanup process has been completed, the "clean" reservoir fluids drawn into the flowline(s) can be analyzed by the fluid analyzers or sensors of the tool to characterize fluid properties of the reservoir fluids at reservoir temperature and pressure conditions. These fluid properties are typically referred to as live fluid properties. Furthermore, the "clean" reservoir fluids drawn into the flowline(s) can be directed to one or more sample carriers for collection and storage therein. Such sample carriers can be used to carry the collected reservoir fluid samples to the surface (i.e., when the tool is returned to the surface) for analysis in a laboratory at the wellsite or most commonly at another location.

Functionality similar to the formation tester tool as described above has also been incorporated into the bottom hole assembly of a drilling system to analyze and collect samples of reservoir fluids while drilling. An example of such a system is the SpectraSphere while-drilling service commercially available by Schlumberger of Houston, Texas.

While some contamination in a reservoir fluid sample can be managed in the laboratory and are easy to remove (such as sampling formation oil with water-based drilling fluid or sampling formation water with oil-based drilling fluid), some others are difficult (such as sampling formation oil with oil-based drilling fluid or sampling formation water with water-based drilling fluid) and affect the measurements performed on the reservoir fluid sample. For example, if the formation is drilled with oil-based drilling fluid, it is very difficult to detect and remove the contamination in hydrocarbons. Therefore, part of the contamination will mix with the sampled reservoir hydrocarbon, resulting in different measured density and viscosity. Thus, such error in this data, if not detected and accounted for properly, will affect some decisions in reservoir development and planning.

There are several techniques in the literature that detect contamination of the reservoir fluid samples in the flowline of a downhole tool. For example, Zuo, Julian Y., Gisolf, Adriaan, Dumont, Hadrien, Dubost, Francois, Pfeiffer, Thomas, Wang, Kang, Mishra, Vinay K., Chen, Li, Mullins, Oliver C., Biagi, Mario, and Serafino Gemelli. "A Breakthrough in Accurate Downhole Fluid Sample Contamination Prediction in Real Time," paper presented at the SPWLA 56th Annual Logging Symposium, Long Beach, California, USA, July 2015, describes a mixing rule based on optical density, where an optical method is used assuming that the crude oil is "dark" in an optical color channel and the drilling fluid filtrate is assumed "colorless". This method, however, has limitations that make it difficult to identify contamination in the case that oil-based drilling fluid filtrate is not colorless in specified channels or the reservoir fluid is not exhibiting color. In another example, Bouton, J., Prammer, M. G., Masak, P., and S. Menger. "Assessment of Sample Contamination by Downhole NMR Fluid Analysis," paper presented at the SPE Annual Technical Conference and Exhibition, New Orleans, Louisiana, September 2001. doi: https://doi.org/10.2118/71714.MS describes the use of nuclear magnetic resonance (NMR) to identify contamination, where the relaxation time (T1) of oil-based drilling fluid filtrate can be differentiated from reservoir hydrocarbons. Although this NMR method shows good interpretation results to detect contamination, it can be affected by the presence of hydrocarbon gases like methane.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure relates to a method that includes configuring a downhole tool disposed within a wellbore adjacent a reservoir to perform fluid sampling operations that draw live reservoir fluid from the reservoir into the downhole tool. The live reservoir fluid is at elevated pressure and temperature conditions of the reservoir. The live reservoir fluid is analyzed within the downhole tool to determine fluid properties of the live reservoir fluid. Interfacial tension of the live reservoir fluid can be determined from the fluid properties of the live reservoir fluid. The interfacial tension of the live reservoir fluid can be used to characterize and assess quality, or level of drilling fluid contamination, of the live reservoir fluid.

In embodiments, the method can further involve controlling the fluid sampling operations based on the quality of the live reservoir fluid.

In other embodiments, the method can further involve measuring or recording at least one fluid property of the reservoir fluid upon determining that the quality of the reservoir fluid is acceptable.

In still other embodiments, the method can further involve selectively collecting and storing the reservoir fluid in at least one sample carrier within the downhole tool upon determining that the quality of the reservoir fluid is acceptable.

In embodiments, the downhole tool can be part of a wireline system.

In other embodiments, the downhole tool can be part of a bottom hole assembly of a drilling system.

The present disclosure also relates to a downhole tool that includes a probe configured to perform fluid sampling operations that draw live reservoir fluid from a reservoir into the downhole tool. The live reservoir fluid is at elevated pressure and temperature conditions of the reservoir. The downhole tool also includes at least one fluid analyzer configured to analyze the live reservoir fluid within the downhole tool to determine fluid properties of the live reservoir fluid. The downhole tool also includes a controller or processor configured to determine interfacial tension of the live reservoir fluid based on the fluid properties of the live reservoir fluid and use the interfacial tension of the live reservoir fluid to characterize and assess quality of the live reservoir fluid.

In embodiments, the controller or processor can be further configured to control the fluid sampling operations based on the quality of the live reservoir fluid.

In embodiments, the controller or processor can be further configured to control the at least one fluid analyzer to measure or record at least one fluid property of the reservoir fluid upon determining that the quality of the reservoir fluid is acceptable.

In embodiments, the downhole tool can include at least one sample carrier within the tool. The controller or processor can be further configured to take actions to store the reservoir fluid in the at least one sample carrier upon determining that the quality of the reservoir fluid is acceptable.

In embodiments, the quality of the reservoir fluid can be dependent on amount of drilling fluid contamination in the reservoir fluid.

In embodiments, the IFT of the live reservoir fluid can be determined using a correlation function that is based on a predefined set of fluid properties of the live reservoir fluid as measured by downhole fluid analysis of the live reservoir fluid.

In embodiments, the predefined set of fluid properties can include fluid density of a hydrocarbon (oil) component of the live reservoir fluid, viscosity of the hydrocarbon (oil) component of the live reservoir fluid, fluid density of a water component of the live reservoir fluid, and reservoir temperature.

In embodiments, the correlation function can take the form $$IFT_{live} = \frac{\rho_{o,live}}{\rho_{w,live}} * \left[ \frac{[1.58(\rho_{w,live} - \rho_{o,live}) + 1.76]}{\left[\frac{T}{145.39\mu_{o,live} + 830.95}\right]^{0.3215}} \right]^4 - \frac{\mu_{o,live}}{\rho_{o,live}}$$

where $IFT_{live}$ is the IFT of the live reservoir fluid, $\rho_{o,live}$ is the fluid density of the hydrocarbon (oil) component of the live reservoir fluid; $\mu_{o,live}$ is the viscosity of the hydrocarbon (oil) component of the live reservoir fluid; $\rho_{w,live}$ is the fluid density of the water component of the live reservoir fluid; and T is the reservoir temperature.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein:

FIG. 6 is a table (Table 2) that illustrates the sensitivity to hydrocarbon (oil) viscosity in a correlation function for calculating IFT according to aspects of present disclosure;

FIG. 7 is a table (Table 3) that illustrates the sensitivity to hydrocarbon (oil) density in a correlation function for calculating IFT according to aspects of present disclosure.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to methods and systems that configure a downhole tool disposed within a wellbore adjacent a reservoir to perform fluid sampling operations that draw live reservoir fluid from the reservoir into the downhole tool. The live reservoir fluid is at elevated pressure and temperature conditions of the reservoir. The live reservoir fluid is analyzed within the downhole tool to determine fluid properties of the live reservoir fluid. Interfacial tension of the live reservoir fluid can be determined or predicted from the fluid properties of the live reservoir fluid. The interfacial tension of the live reservoir fluid can be used to characterize and assess quality (or degree of contamination) of the live reservoir fluid in substantially real-time. The characterization and assessment of the quality of the live reservoir fluid can be used to control the sampling operations or initiate downhole fluid analysis or sample collection for analysis of "clean" reservoir fluid of acceptable quality.

Figure 1A:
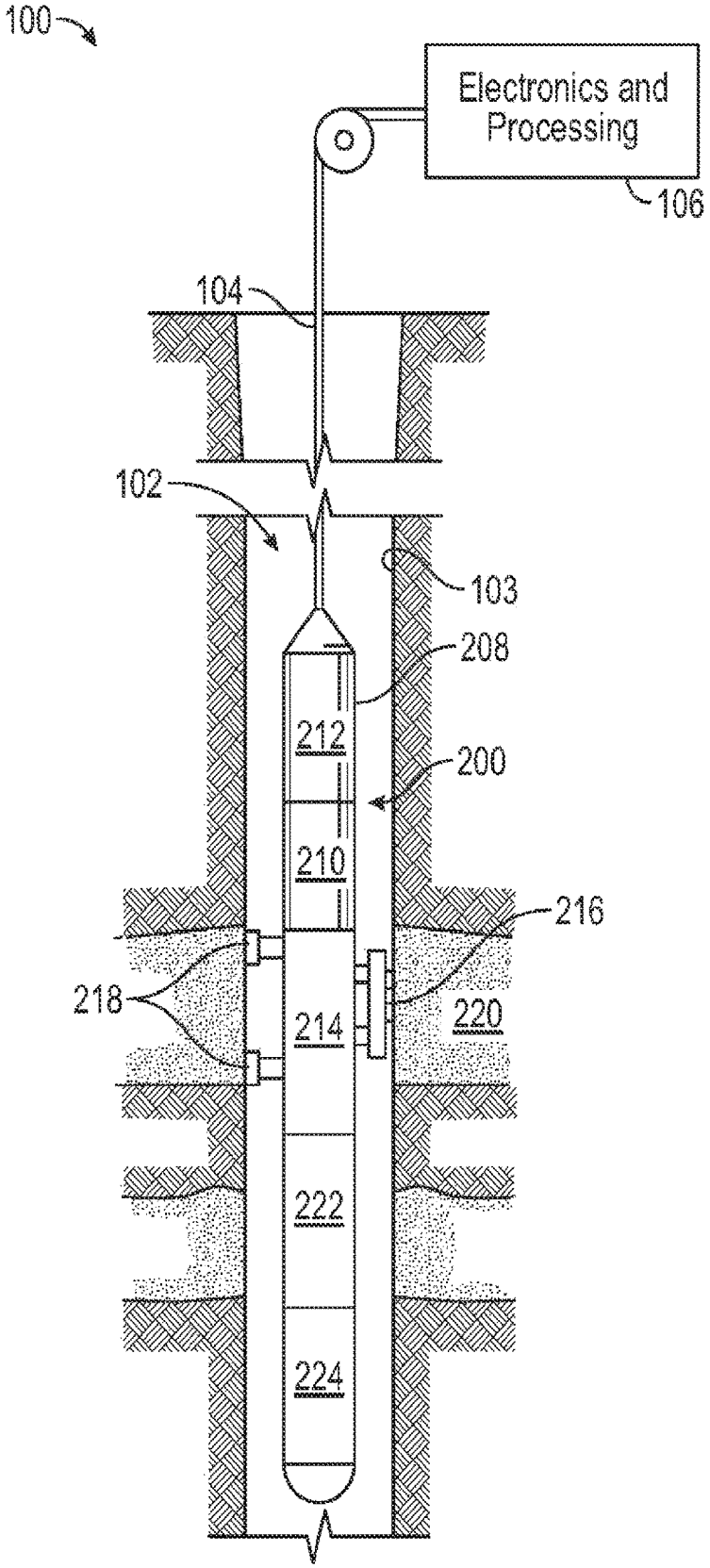
FIG. 1A is a schematic view of an embodiment of a wellsite system according to aspects of the present disclosure.
Figure 1B:
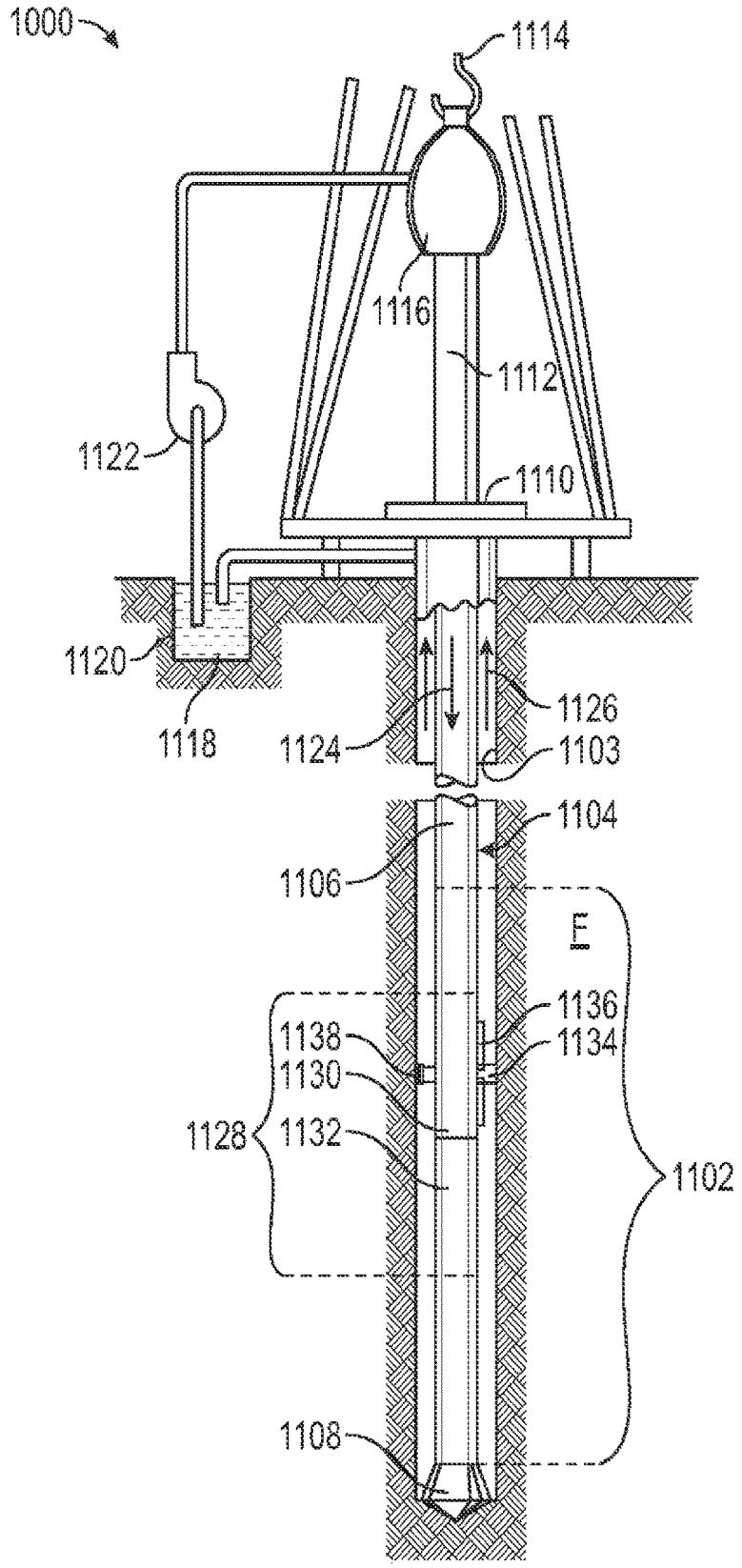
FIG. 1B is a schematic view of a drilling system according to aspects of the present disclosure.

FIGS. 1A and 1B depict examples of wellsite systems that can employ the techniques and methods described herein.

FIG. 1A depicts an example of a wireline system 100 that may employ the techniques and workflows as described herein. The system 100 includes a downhole tool 200 that is suspended in an uncased wellbore (or open-hole) 102 from the lower end of a multi-conductor cable 104 that is spooled on a winch at the surface. The cable 104 is communicatively coupled to an electronics and processing system 106. The downhole tool 200 includes an elongated body 208 that houses modules 210, 212, 214, 222, and 224, that provide various functionalities including fluid sampling, fluid testing, operational control, and communication, among others. For example, the modules 210 and 212 may provide additional functionality such as downhole fluid analysis, resistivity measurements, operational control, communications, coring, and/or imaging, among others.

As shown in FIG. 1A, the module 214 has a selectively extendable probe 216 and backup pistons 218 that are arranged on opposite sides of the elongated body 208. The extendable probe 216 is configured to selectively seal off or isolate selected portions of the wall 103 of the uncased wellbore 102 and fluidly couple the probe 216 to a hydrocarbon-bearing reservoir within the formation 220 and draw reservoir fluid from the reservoir. The probe 216 may include a single inlet or multiple inlets designed for guarded or focused sampling. In the illustrated example, the electronics and processing system 206 and/or a downhole control system are configured to control the extendable probe assembly 216 and/or the drawing of reservoir fluid from the reservoir.

The module 214 can include one or more flowlines that carry the flow of reservoir fluids sampled by the probe 216. The module 214 can also include one or more pumps and pressure sensors that may be employed to conduct formation pressure tests and draw in reservoir fluids into the flowline (s) via the probe 216. The one or more flowlines can be configured to carry the reservoir fluids to one or more fluid analyzers that provide downhole fluid analysis (DFA) measurements. For example, the one or more fluid analyzers can include an optical spectrometer and/or a gas analyzer designed to measure properties such as, optical density, fluid fluorescence, fluid composition, and the fluid gas oil ratio (GOR), among others. The one or more fluid analyzers can also include one or more additional measurement devices, such as temperature sensors, pressure sensors, viscosity sensors, density sensors, resistivity sensors, chemical sensors (e.g., for measuring pH or $H_2S$ levels), and gas chromatographs. In some embodiments, the one or more fluid analyzers can be configured to measure absorption spectra and translate such measurements into concentrations of several alkane components and groups in the reservoir fluid that flows through the flowline(s). For example, the one or more fluid analyzers may determine the concentrations (e.g., weight percentages) of carbon dioxide ($CO_2$), methane ($CH_4$), ethane ($C_2H_6$), the $C_3$-$C_5$ alkane group, and the lump of hexane and heavier alkane components ($C_6$+).

The module 214 may also include a controller, such as a microprocessor or control circuitry, designed to calculate and record certain fluid properties based on the sensor measurements. For example, the controller may calculate interfacial tension (IFT) of the reservoir fluid as described further below with respect to FIGS. 2A and 2B or FIGS. 3A and 3B. Further, in certain embodiments, the controller may control sampling operations based on the fluid measurements or properties. Moreover, in other embodiments, the controller may be disposed within another module of the downhole tool 200.

The reservoir fluid that flows through the flowline(s) of the module 214 may be expelled to the wellbore 102 through a port in the body 208, or the reservoir fluid may be directed to flow to one or more fluid sampling modules 222 and 224. The fluid sampling modules 222 and 224 can include sample carriers that collect and store the reservoir fluid supplied thereto. The sample carrier(s) can be configured to carry reservoir fluid samples to the surface (as the downhole tool 200 is returned to the surface) for testing the reservoir fluid samples in a laboratory at or near the wellsite (or at a remote location). A pump can be used to provide motive force to direct the fluid through the downhole tool as needed. According to certain embodiments, the pump may be a hydraulic displacement unit that receives fluid into alternating pump chambers.

FIG. 1B depicts a drilling system 1000 that may employ the techniques and workflows as described herein. The drilling system 1000 has a bottom hole assembly 1102 suspended therefrom and into a wellbore 1104 via a drill string 1106. The bottom hole assembly 1102 has a drill bit 1108 at its lower end thereof that is used to advance the bottom hole assembly 1102 into the formation F and form the wellbore 1104. The drill string 1106 is rotated by a rotary table 1110, energized by means not shown, which engages a kelly joint 1112 at the upper end of the drill string 1106. The drill string 1106 is suspended from a hook 1114, attached to a traveling block (also not shown), through the kelly joint 1112 and a rotary swivel 1116 that permits rotation of the drill string 1106 relative to the hook 1114. The drilling rig 1000 is depicted as a land-based platform and derrick assembly used to form the wellbore 1104 by rotary drilling. However, in other embodiments, the drilling rig 1000 may be an offshore platform.

Drilling fluid (or mud) 1118 is stored in a pit 1120 formed at the well site. A pump 1122 delivers the drilling fluid 1118 to the interior of the drill string 1106 via a port in the swivel 1116, inducing the drilling fluid to flow downwardly through the drill string 1106 as indicated by a directional arrow 1124. The drilling fluid exits the drill string 1106 via ports in the drill bit 1108, and then circulates upwardly through the region between the outside of the drill string 1106 and the wall of the wellbore 1004, called the annulus, as indicated by directional arrows 1126. The drilling fluid lubricates the drill bit 1108 and carries formation cuttings up to the surface as it is returned to the pit 1120 for recirculation.

The bottom hole assembly (or downhole tool) 1102 can include various components with different capabilities, such as measuring, processing, and storing information, as well as communicating with the surface. A telemetry device (not shown) also may be provided for communicating with a surface unit (not shown).

The bottom hole assembly 1102 includes a fluid sampling and analysis system 1128 that includes modules 1130 and 1132. The modules 1130 and 1132 may be housed in a drill collar for performing various formation evaluation functions, such as pressure testing and sampling, among others. The module 1130 includes a probe 1134, which may be supported by a stabilizer blade or rib 1136. The probe 1134 includes one or more inlets for establishing fluid communication with a hydrocarbon-bearing reservoir within the formation F and drawing in reservoir fluid from the reservoir. In certain embodiments, the probe 1134 may include a single inlet. In other embodiments, the probe may include multiple inlets that may, for example, be used for focused sampling. The probe 1134 may be movable between extended and retracted positions for selectively engaging a wall 1103 of the wellbore 1104 and acquiring reservoir fluid from the reservoir. One or more setting pistons 1138 may be provided to assist in positioning the probe 1134 against the wellbore wall.

The module 1130 can also include one or more flowlines that carry the flow of reservoir fluids sampled by the probe 1134. The module 1130 can also include one or more pumps and pressure sensors that may be employed to conduct formation pressure tests and draw in reservoir fluids into the flowline(s) via the probe 1134. The one or more flowlines can be configured to carry the reservoir fluids to one or more fluid analyzers that provide downhole fluid analysis (DFA) measurements within the module 1130. For example, the one or more fluid analyzers can include an optical spectrometer and/or a gas analyzer designed to measure properties such as, optical density, fluid fluorescence, fluid composition, and the fluid gas oil ratio (GOR), among others. The one or more fluid analyzers can also include one or more additional measurement devices, such as temperature sensors, pressure sensors, viscosity sensors, density sensors, resistivity sensors, chemical sensors (e.g., for measuring pH or $H_2S$ levels), and gas chromatographs. In some embodiments, the one or more fluid analyzers can be configured to measure absorption spectra and translate such measurements into concentrations of several alkane components and groups in the reservoir fluid that flows through the flowline(s). For example, the one or more fluid analyzers may determine the concentrations (e.g., weight percentages) of carbon dioxide ($CO_2$), methane ($CH_4$), ethane ($C_2H_6$), the $C_3$-$C_5$ alkane group, and the lump of hexane and heavier alkane components ($C_6$+).

The module 1130 may also include a controller, such as a microprocessor or control circuitry, designed to calculate and record certain fluid properties based on the sensor measurements. For example, the controller may calculate IFT of the reservoir fluid as described further below with respect to FIGS. 2A and 2B or FIGS. 3A and 3B. Further, in certain embodiments, the controller may control sampling operations based on the fluid measurements or properties. Moreover, in other embodiments, the controller may be disposed within another module of the bottom hole assembly 1102.

The reservoir fluid that flows through the flowline(s) of the module 1130 may be expelled to the wellbore 1104 through a port in the bottom hole assembly 1102, or the reservoir fluid may be directed to flow to the module 1132. The module 1132 can include sample carriers that collect and store the reservoir fluid supplied thereto. The sample carriers can be configured to carry reservoir fluid samples to the surface (as the downhole tool 200 is returned to the surface) for testing the reservoir fluid samples in a laboratory at or near the wellsite (or at a remote location). A pump can be used to provide motive force to direct the fluid through the bottom hole assembly 1102 as needed. According to certain embodiments, the pump may be a hydraulic displacement unit that receives fluid into alternating pump chambers.

Figure 2A:
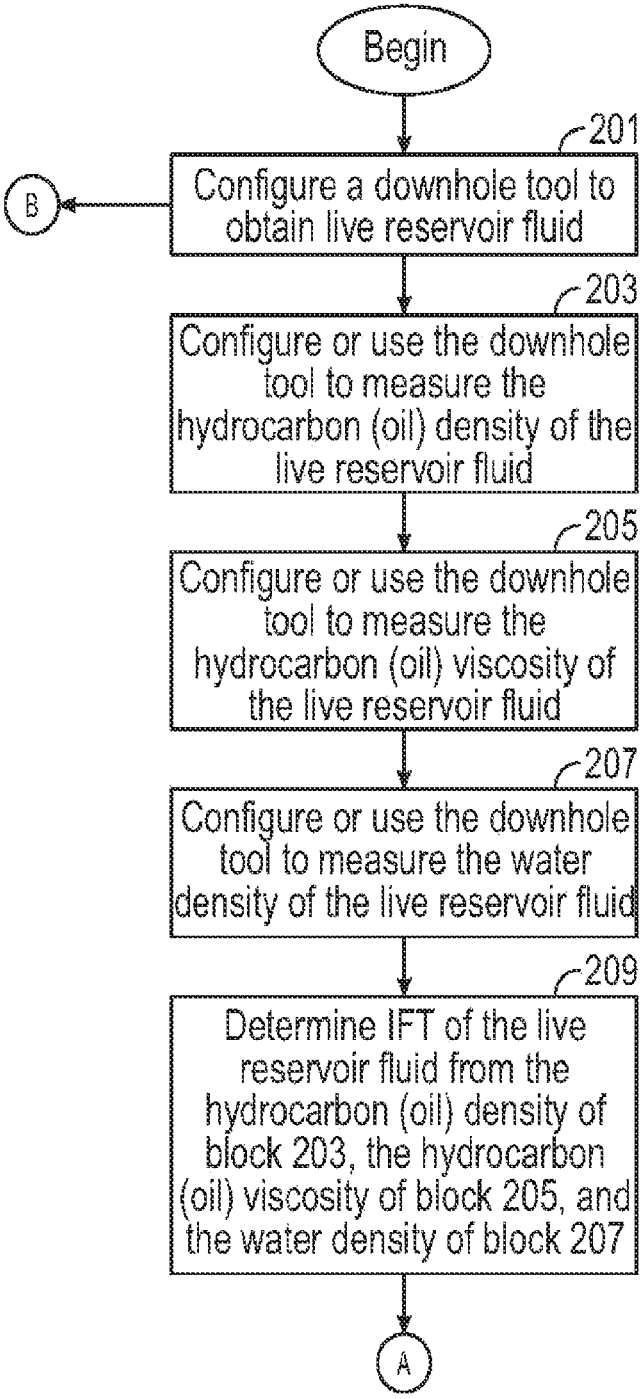
FIGS. 2A and 2B, collectively, is a flowchart depicting a method to check the quality of reservoir fluid while sampling the reservoir fluid according to aspects of the present disclosure.
Figure 2B:
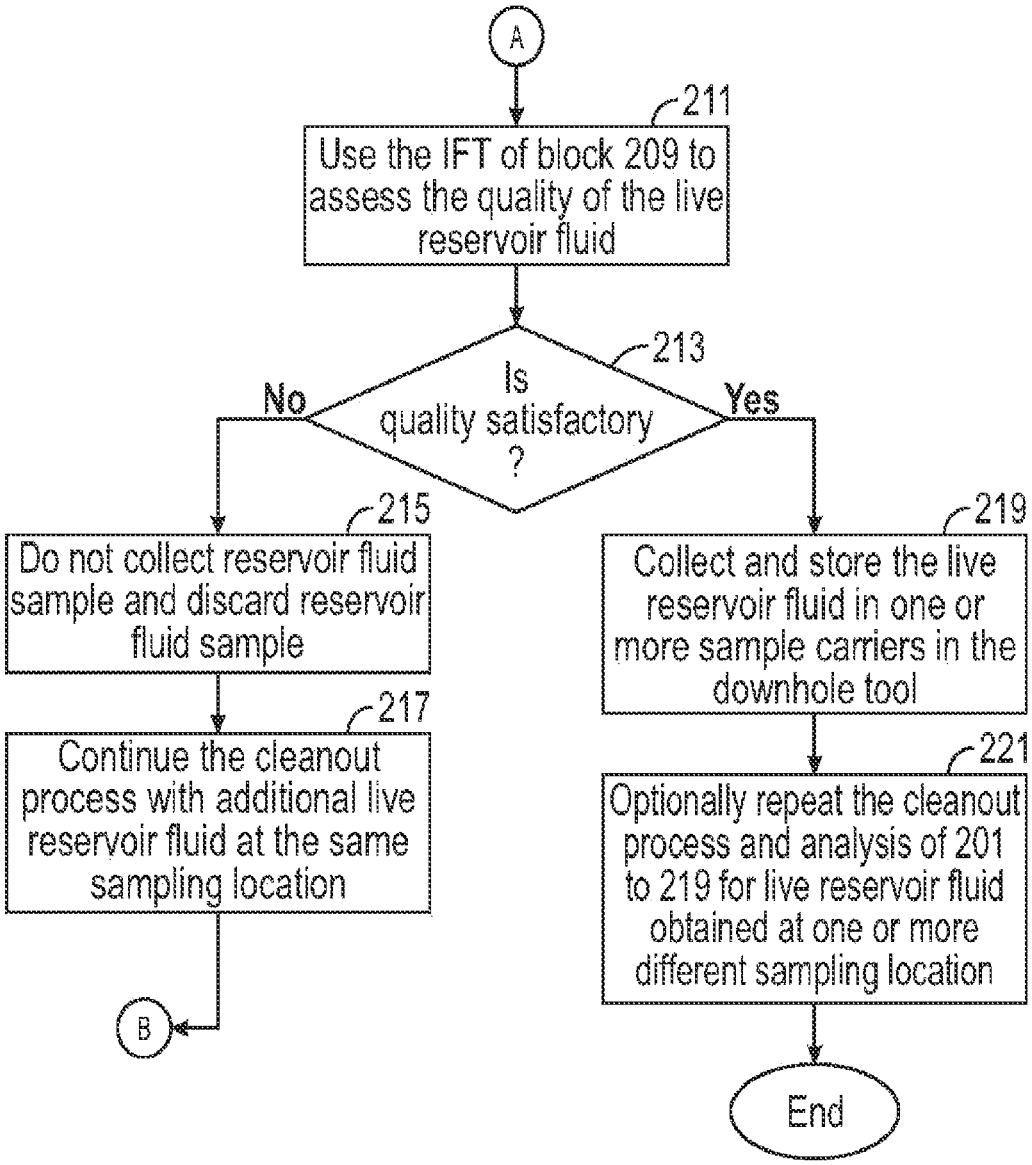

FIGS. 2A and 2B, collectively, is a flowchart depicting an embodiment of a method that may be employed to check the quality (or a level of contamination) of reservoir fluid while sampling the reservoir fluid. The sampled reservoir fluid is live reservoir fluid at the elevated pressure and temperature conditions of the formation/reservoir from which the reservoir fluid is obtained. For oil reservoirs, the live reservoir fluid can include two components, a hydrocarbon (oil) component and a water component for connate water.

In block 201, a downhole tool, such as the downhole tool 200 of FIG. 1A or the bottom hole assembly 1102 of FIG. 1B, is configured to obtain live reservoir fluid from a formation/reservoir and begin a cleanout process to assess the quality of the live reservoir fluid.

In block 203, the downhole tool is configured or used to perform downhole fluid analysis that measures the fluid density of the hydrocarbon (oil) component of the live reservoir fluid.

In block 205, the downhole tool is configured or used to perform downhole fluid analysis that measures the viscosity of the hydrocarbon (oil) component of the live reservoir fluid.

In block 207, the downhole tool is configured or used to perform downhole fluid analysis that measures the fluid density of the water component of the live reservoir fluid.

The downhole fluid analysis of blocks 203 to 207 can be performed by one or more fluid analyzers or sensors that are part of the downhole tool. Examples of such fluid analyzers and sensors are described above with respect to FIGS. 1A and 1B.

In block 209, the IFT of the live reservoir fluid is determined from the hydrocarbon (oil) density of block 203, the hydrocarbon (oil) viscosity of block 205, and the water density of block 207.

In embodiments, the IFT of the live reservoir fluid can be calculated using a correlation function that is based on a predefined set of inputs as measured by the downhole fluid analysis, which can include fluid density of the hydrocarbon (oil) component of the live reservoir fluid, viscosity of the hydrocarbon (oil) component of the live reservoir fluid, fluid density of the water component of the live reservoir fluid, and reservoir temperature.

In embodiments, the IFT of the live reservoir fluid can be calculated using a correlation function of the form:

$$IFT_{live} = \frac{\rho_{o,live}}{\rho_{w,live}} * \left[ \frac{[1.58(\rho_{w,live} - \rho_{o,live}) + 1.76]}{\left[\frac{T}{145.39\mu_{o,live} + 830.95}\right]^{0.3215}} \right]^4 - \frac{\mu_{o,live}}{\rho_{o,live}} \quad \text{Eqn. (1)}$$

where $IFT_{live}$ is the IFT of the live reservoir fluid, $\rho_{o,live}$ is the fluid density of the hydrocarbon (oil) component of the live reservoir fluid; $\mu_{o,live}$ is the viscosity of the hydrocarbon (oil) component of the live reservoir fluid; $\rho_{w,live}$ is the fluid density of the water component of the live reservoir fluid; and Tis the reservoir temperature.

In blocks 211 and 213, the IFT of block 209 is used to characterize and assess the quality, or level of contamination, of the live reservoir fluid. For example, the IFT of block 209 can be compared to maximum and minimum threshold levels that are characteristic of an acceptable level of filtrate contamination in the live reservoir fluid. If the IFT of block 209 is within the range of the maximum and minimum threshold levels, the operations can determine that the quality of the live reservoir fluid is acceptable.

For the case where the quality of the live reservoir fluid is determined not to be acceptable, the cleanout process is incomplete and the operations continue to block 215 and block 217.

In block 215, the live reservoir fluid is not collected, but discarded, for example into the wellbore.

In block 217, the cleanout process can continue by reverting to block 201 to repeat the process of blocks 201 to 213 for additional reservoir fluid obtained from the same sampling location. It is expected that the quality (contamination level) of the reservoir fluid will improve over time and reach an acceptable level at some subsequent point in time.

For the case where the quality of the live reservoir fluid is determined to be acceptable, the cleanout process can be deemed complete and the operations continue to block 219 and 221.

In block 219, the live reservoir fluid can be collected and stored in one or more sample carriers in the downhole tool. Furthermore, one or more fluid analyzers or sensors that are part of the downhole tool can be configured or used to perform downhole fluid analysis that measures and/or records one or more properties of the "clean" live reservoir fluid for subsequent analysis of the reservoir fluids.

In optional block 221, the cleanout process and analysis of blocks 201 to 219 can be repeated for live reservoir fluid obtained at one or more different sampling locations.

Figure 3A:
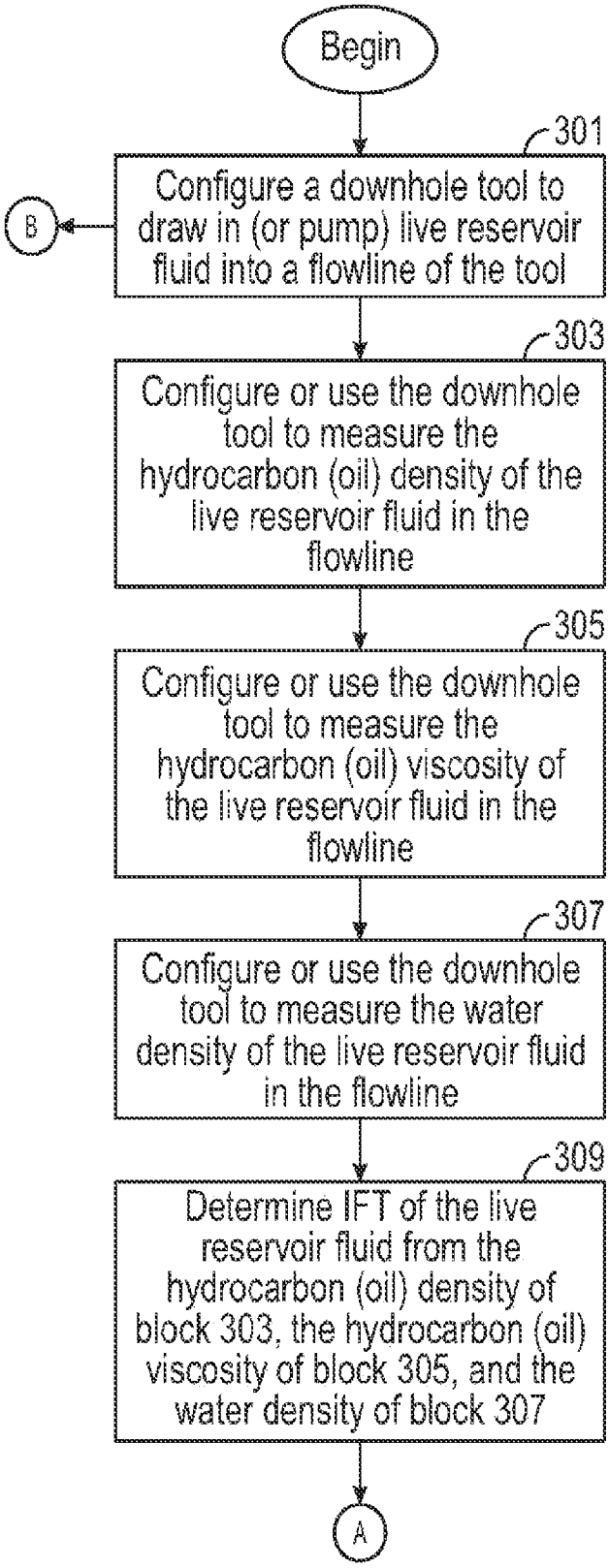
FIGS. 3A and 3B, collectively, is a flowchart depicting another method to check the quality of reservoir fluid while sampling the reservoir fluid according to aspects of the present disclosure.
Figure 3B:
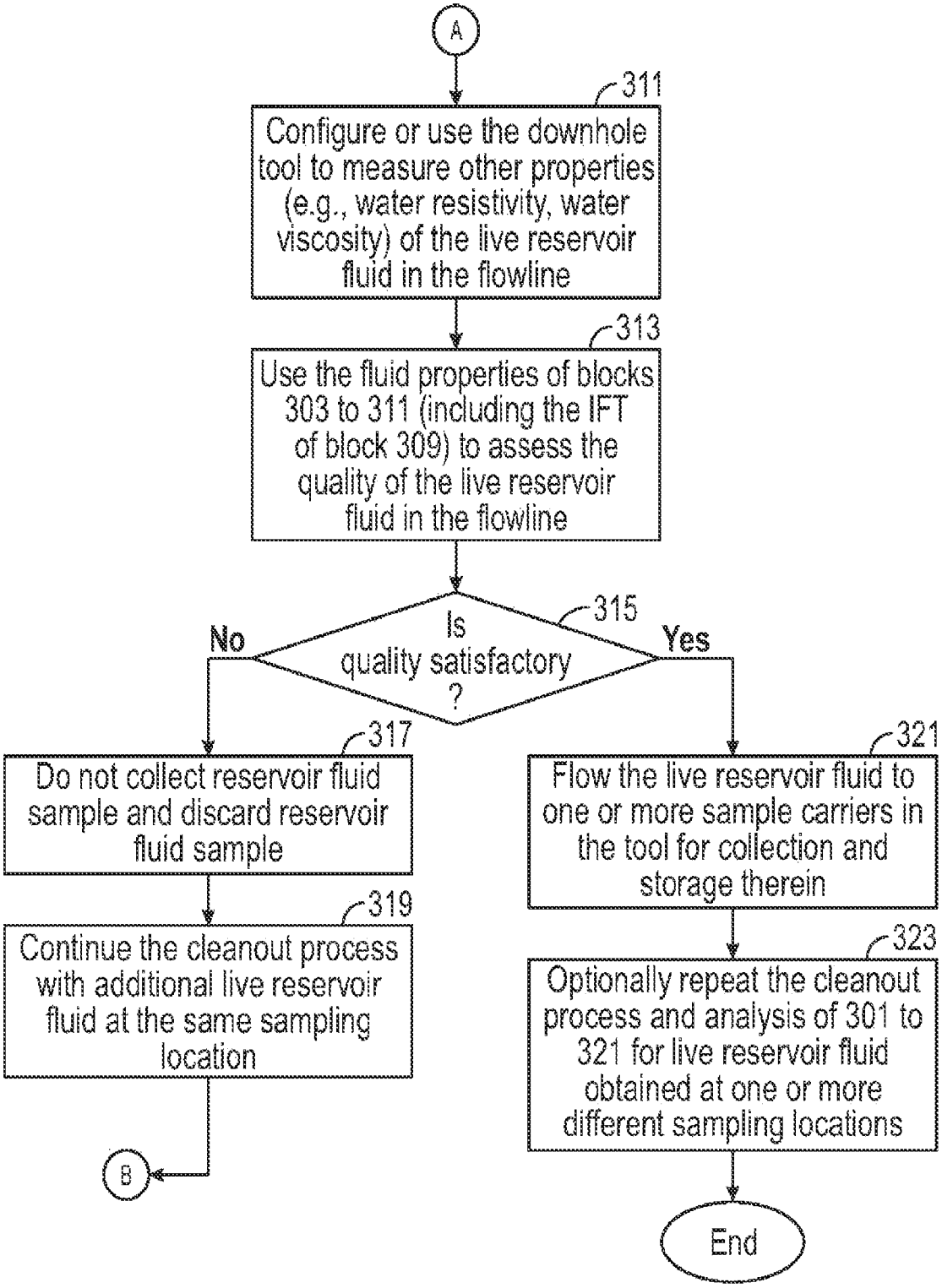

FIGS. 3A and 3B, collectively, is a flowchart depicting an embodiment of a method that may be employed to check the quality of reservoir fluid while sampling the reservoir fluid. The sampled reservoir fluid is live reservoir fluid at the elevated pressure and temperature conditions of the formation/reservoir from which the reservoir fluid is obtained. For oil reservoirs, the live reservoir fluid can include two components, a hydrocarbon (oil) component and a water component for connate water.

In block 301, a downhole tool, such as the downhole tool 200 of FIG. 1A or the bottom hole assembly 1102 of FIG. 1B, is configured to draw in (or pump) live reservoir fluid into a flowline of the tool and begin a cleanout process to assess the quality of the live reservoir fluid.

In block 303, the downhole tool is configured or used to perform downhole fluid analysis that measures the fluid density of the hydrocarbon (oil) component of the live reservoir fluid in the flowline.

In block 305, the downhole tool is configured or used to perform downhole fluid analysis that measures the viscosity of the hydrocarbon (oil) component of the live reservoir fluid in the flowline.

In block 307, the downhole tool is configured or used to perform downhole fluid analysis that measures the fluid density of the water component of the live reservoir fluid in the flowline.

The downhole fluid analysis of blocks 303 to 307 can be performed by one or more fluid analyzers or sensors that are part of the downhole tool. Examples of such fluid analyzers and sensors are described above with respect to FIGS. 1A and 1B.

In block 309, the IFT of the live reservoir fluid is determined from the hydrocarbon (oil) density of block 303, the hydrocarbon (oil) viscosity of block 305, and the water density of block 307.

In embodiments, the IFT of the live reservoir fluid can be calculated using a correlation function that is based on a predefined set of properties of the live reservoir fluid as measured by the downhole fluid analysis, which can include fluid density of the hydrocarbon (oil) component of the live reservoir fluid, viscosity of the hydrocarbon (oil) component of the live reservoir fluid, fluid density of the water component of the live reservoir fluid, and reservoir temperature. In embodiments, the IFT of the live reservoir fluid can be calculated using a correlation function of Eqn. (1) as set forth above.

In blocks 311, the downhole tool is configured or used to perform downhole fluid analysis that measures other properties (e.g., water resistivity, water viscosity) of the live reservoir fluid in the flowline.

In blocks 313 and 315, the fluid properties of blocks 303 to 311 (including the IFT of block 309) can be used to characterize and assess the quality of the live reservoir fluid in the flowline. For example, the IFT of block 309 can be compared to minimum and maximum threshold levels that are characteristic of an acceptable level of filtrate contamination in the live reservoir fluid. If the IFT of block 309 is within the range of minimum and maximum threshold levels, the operations can determine that the quality of the live reservoir fluid is acceptable. Otherwise, the operations can determine that the quality of the live reservoir is not acceptable. All the other measurements, such as resistivity, density, etc. should show a transition from almost 100% drilling fluid to a constant plateau, which is normally assumed to represent clean reservoir fluid formation fluid. The problem with this method is that a plateau only indicates that the incoming fluid has a constant measured property, not necessarily 'clean' formation fluid, for example, in cases where a constant supply of drilling fluid is possible.

For the case where the quality of the live reservoir fluid is determined not to be acceptable, the cleanout process is incomplete and the operations continue to block 317 and block 319.

In block 317, the live reservoir fluid in the flowline is not collected, but discarded, for example into the wellbore.

In block 319, the cleanout process can continue by reverting to block 301 to repeat the process of blocks 301 to 315 for additional reservoir fluid obtained from the same sampling location. It is expected that the quality (contamination level) of the reservoir fluid will improve over time and reach an acceptable level at some subsequent point in time.

For the case where the quality of the live reservoir fluid is determined to be acceptable, the cleanout process can be deemed complete and the operations continue to block 321 and 323.

In block 321, the live reservoir fluid in the flowline can be directed or routed to one or more sample carriers in the tool for collection and storage therein. Furthermore, one or more fluid analyzers or sensors that are part of the downhole tool can be configured or used to perform downhole fluid analysis that measures and/or records one or more properties of the "clean" live reservoir fluid for subsequent analysis of the reservoir fluids.

In optional block 323, the cleanout process and analysis of blocks 301 to 321 can be repeated for live reservoir fluid obtained at one or more different sampling locations.

Figures 4, 5:
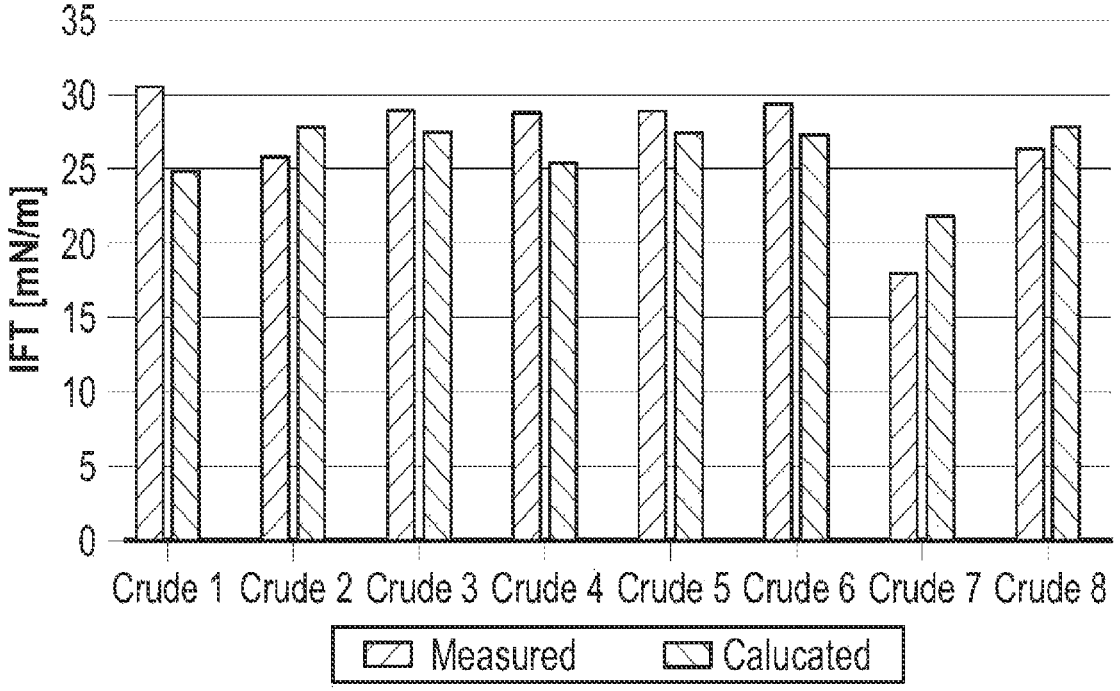
FIG. 4 is a table (Table 1) that shows measured fluid properties of eight different crude oils.
FIG. 5 shows the IFT calculated according to aspects of present disclosure together with the IFT measured by laboratory experiments for each of the eight crude oils of FIG. 4.

The table of FIG. 4 (Table 1) shows the measured fluid properties of eight different crude oils, and FIG. 5 shows the IFT calculated according to the correlation function of Eqn. (1) above together with the IFT measured by laboratory experiments for each of the eight crude oils of FIG. 4. From this data, one can see very good agreement with an acceptable error range.

Note that the correlation function of Eqn. (1) is very sensitive to the input parameters ($\rho_{o,live}$, $\mu_{o,live}$, $\rho_{w,live}$, and T) and specifically to the hydrocarbon (oil) viscosity input parameter ($\mu_{o,live}$). Specifically, drilling fluid contamination typically will have a small impact on the hydrocarbon (oil) fluid density but will significantly affect the measured hydrocarbon (oil) viscosity. Therefore, it will result in unrealistic IFT value, and hence gives an idea on the quality of the sampled reservoir fluid.

The table of FIG. 6 (Table 2) illustrates the results of testing the sensitivity to hydrocarbon (oil) viscosity in the correlation function of Eqn. (1) for two different reservoir oil samples. It can be seen that changes in the hydrocarbon (oil) viscosity cause the IFT to reach values above 37 mN/m, which is normally unusual for reservoir crude oils.

The table of FIG. 7 (Table 3) illustrates the results of testing the sensitivity to hydrocarbon (oil) density in the correlation function of Eqn. (1) for the same two different reservoir oil samples. It can be seen that changes in the hydrocarbon (oil) density resulted in slight decrease in IFT.

Figure 8:
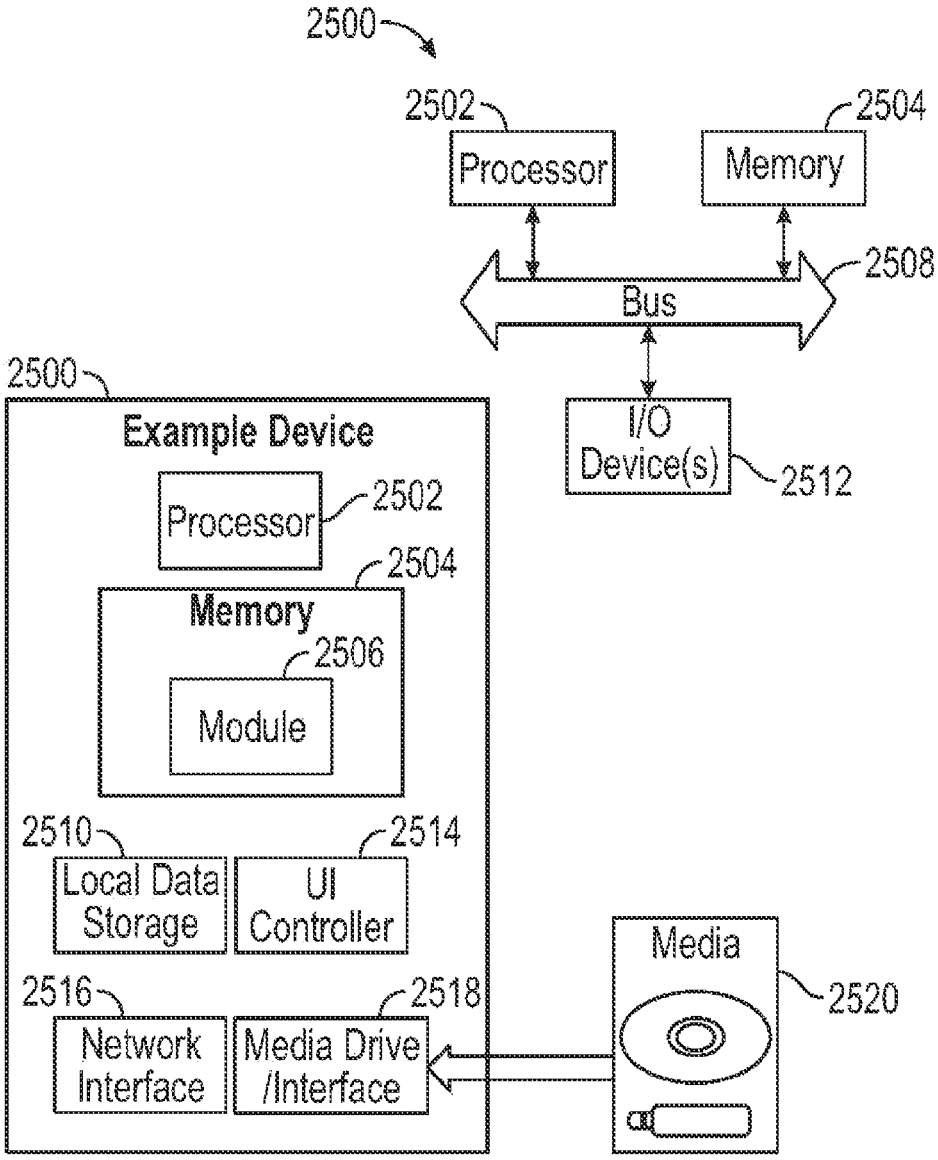
FIG. 8 is a schematic diagram of a computer system.

In some embodiments, the methods and systems of the present disclosure may involve a computing system. FIG. 8 illustrates an example computing system 2500, with a processor 2502 and memory 2504 that can be configured to implement various embodiments of the subject disclosure. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and nonvolatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claims expressly uses the words 'means for' together with an associated function.

What is claimed is:

1. A method comprising:

configuring a downhole tool disposed within a wellbore adjacent a reservoir to perform fluid sampling operations that draw live reservoir fluid from the reservoir into the downhole tool, wherein the live reservoir fluid is at elevated pressure and temperature conditions of the reservoir;

analyzing the live reservoir fluid within the downhole tool to determine fluid properties of the live reservoir fluid;

determining interfacial tension (IFT) of the live reservoir fluid based on the fluid properties of the live reservoir fluid; and characterizing quality of the live reservoir fluid by comparing the IFT of the live reservoir fluid to a threshold range, wherein the quality of the live reservoir fluid is dependent on amount of drilling fluid contamination in the live reservoir fluid.

2. A method according to claim 1, further comprising:

controlling the fluid sampling operations based on the quality of the live reservoir fluid.

3. A method according to claim 1, further comprising:

measuring or recording at least one fluid property of the live reservoir fluid based on the quality of the live reservoir fluid.

4. A method according to claim 1, further comprising:

selectively collecting and storing the live reservoir fluid in at least one sample carrier within the downhole tool based on the quality of the live reservoir fluid.

5. A method according to claim 1, wherein:

the IFT of the live reservoir fluid is determined using a correlation function that is based on a predefined set of fluid properties of the live reservoir fluid as measured by downhole fluid analysis of the live reservoir fluid.

6. A method according to claim 5, wherein:

the predefined set of fluid properties includes fluid density of a hydrocarbon (oil) component of the live reservoir fluid, viscosity of the hydrocarbon (oil) component of the live reservoir fluid, fluid density of a water component of the live reservoir fluid, and reservoir temperature.

7. A method according to claim 6, wherein:

the correlation function is of the form $$IFT_{live} = \frac{\rho_{o,live}}{\rho_{w,live}} * \left[ \frac{[1.58(\rho_{w,live} - \rho_{o,live}) + 1.76]}{\left[\frac{T}{145.39\mu_{o,live} + 830.95}\right]^{0.3215}} \right]^4 - \frac{\mu_{o,live}}{\rho_{o,live}}$$

where $IFT_{live}$ is the IFT of the live reservoir fluid, $\rho_{o,live}$ is the fluid density of the hydrocarbon (oil) component of the live reservoir fluid;

$\mu_{o,live}$ is the viscosity of the hydrocarbon (oil) component of the live reservoir fluid;

$\rho_{w,live}$ is the fluid density of the water component of the live reservoir fluid; and T is the reservoir temperature.

8. A method according to claim 1, wherein:

the downhole tool is part of a wireline system.

9. A method according to claim 1, wherein:

the downhole tool is part of a bottom hole assembly of a drilling system.

10. A method according to claim 1, wherein:

the wellbore comprises an open-hole or a cased hole.

11. A downhole tool comprising:

a probe configured to perform fluid sampling operations that draw live reservoir fluid from a reservoir into the downhole tool, wherein the live reservoir fluid is at elevated pressure and temperature conditions of the reservoir;

at least one fluid analyzer configured to analyze the live reservoir fluid within the downhole tool to determine fluid properties of the live reservoir fluid; and a controller or processor configured to determine interfacial tension (IFT) of the live reservoir fluid based on the fluid properties of the live reservoir fluid, and to characterize quality of the live reservoir fluid by comparing the IFT of the live reservoir fluid to a threshold range, wherein the quality of the live reservoir fluid is dependent on amount of drilling fluid contamination in the live reservoir fluid.

12. A downhole tool according to claim 11, wherein:

the controller or processor is further configured to control the fluid sampling operations based on the quality of the live reservoir fluid.

13. A downhole tool according to claim 12, wherein:

the controller or processor is further configured to control the at least one fluid analyzer to measure or record at least one fluid property of the live reservoir fluid based on the quality of the live reservoir fluid.

14. A downhole tool according to claim 11, further comprising:

at least one sample carrier within the tool;

wherein the controller or processor is further configured to take actions to store the live reservoir fluid in the at least one sample carrier based on the quality of the live reservoir fluid.

15. A downhole tool according to claim 11, wherein:

the IFT of the live reservoir fluid is determined using a correlation function that is based on a predefined set of fluid properties of the live reservoir fluid as measured by downhole fluid analysis of the live reservoir fluid.

16. A downhole tool according to claim 15, wherein:

the predefined set of fluid properties includes fluid density of a hydrocarbon (oil) component of the live reservoir fluid, viscosity of the hydrocarbon (oil) component of the live reservoir fluid, fluid density of a water component of the live reservoir fluid, and reservoir temperature.

17. A downhole tool according to claim 16, wherein:

the correlation function is of the form $$IFT_{live} = \frac{\rho_{o,live}}{\rho_{w,live}} * \left[ \frac{[1.58(\rho_{w,live} - \rho_{o,live}) + 1.76]}{\left[\frac{T}{145.39\mu_{o,live} + 830.95}\right]^{0.3215}} \right]^4 - \frac{\mu_{o,live}}{\rho_{o,live}}$$

where $IFT_{live}$ is the IFT of the live reservoir fluid, $\rho_{o,live}$ is the fluid density of the hydrocarbon (oil) component of the live reservoir fluid;

$\mu_{o,live}$ is the viscosity of the hydrocarbon (oil) component of the live reservoir fluid;

$\rho_{w,live}$ is the fluid density of the water component of the live reservoir fluid; and T is the reservoir temperature.

18. A downhole tool according to claim 11, which is configurable or configured as part of a wireline system.

19. A downhole tool according to claim 11, which is configurable or configured as part of a bottom hole assembly of a drilling system.

20. A downhole tool according to claim 11, wherein the wellbore comprises an open-hole or a cased hole.

* * * * *